US009950441B2

(12) United States Patent
Jewell et al.

(10) Patent No.: US 9,950,441 B2
(45) Date of Patent: Apr. 24, 2018

(54) SYSTEMS AND METHODS FOR ADJUSTING MOISTURE CONCENTRATION OF A VENEER

(71) Applicant: Georgia-Pacific Wood Products LLC, Atlanta, GA (US)

(72) Inventors: Robert E. Jewell, Livingston, TX (US); Hudson A. Pope, Fayetteville, GA (US)

(73) Assignee: Georgia-Pacific Wood Products LLC, Atlanta, GA (US)

( * ) Notice: Subject to any disclaimer, the term of this patent is extended or adjusted under 35 U.S.C. 154(b) by 467 days.

(21) Appl. No.: 14/447,061

(22) Filed: Jul. 30, 2014

(65) Prior Publication Data

US 2014/0338709 A1 Nov. 20, 2014

Related U.S. Application Data

(62) Division of application No. 13/480,092, filed on May 24, 2012, now Pat. No. 8,945,666.

(60) Provisional application No. 61/490,088, filed on May 26, 2011.

(51) Int. Cl.

| | |
|---|---|
| ***B05B 12/12*** | (2006.01) |
| ***B27K 1/00*** | (2006.01) |
| ***B05C 5/02*** | (2006.01) |
| ***B27K 1/02*** | (2006.01) |

(52) U.S. Cl.
CPC ..... *B27K 1/00* (2013.01); *B05B 12/12* (2013.01); *B05C 5/0208* (2013.01); *B05C 5/0212* (2013.01); *B27K 1/02* (2013.01)

(58) Field of Classification Search
None
See application file for complete search history.

(56) References Cited

U.S. PATENT DOCUMENTS

| | | | | |
|---|---|---|---|---|
| 6,444,079 | B1 * | 9/2002 | Bielfeldt | B27D 1/04 156/264 |
| 2003/0029517 | A1 * | 2/2003 | Kumpulainen | F26B 13/008 144/329 |
| 2004/0074981 | A1 * | 4/2004 | Hamel | D21G 7/00 239/11 |

* cited by examiner

*Primary Examiner* — Jethro M Pence
(74) *Attorney, Agent, or Firm* — Ram W. Sabnis

(57) ABSTRACT

Systems and methods for adjusting a moisture concentration of veneer are provided. In at least one specific embodiment, the method for adjusting a moisture concentration of a veneer can include estimating a moisture concentration of a veneer surface at one or more locations thereon. The method can also include comparing the one or more estimated locations to a minimum moisture concentration level. The method can also include moisturizing at least a portion of the one or more estimated locations that are below the minimum moisture concentration level to increase the moisture concentration thereof.

20 Claims, 1 Drawing Sheet

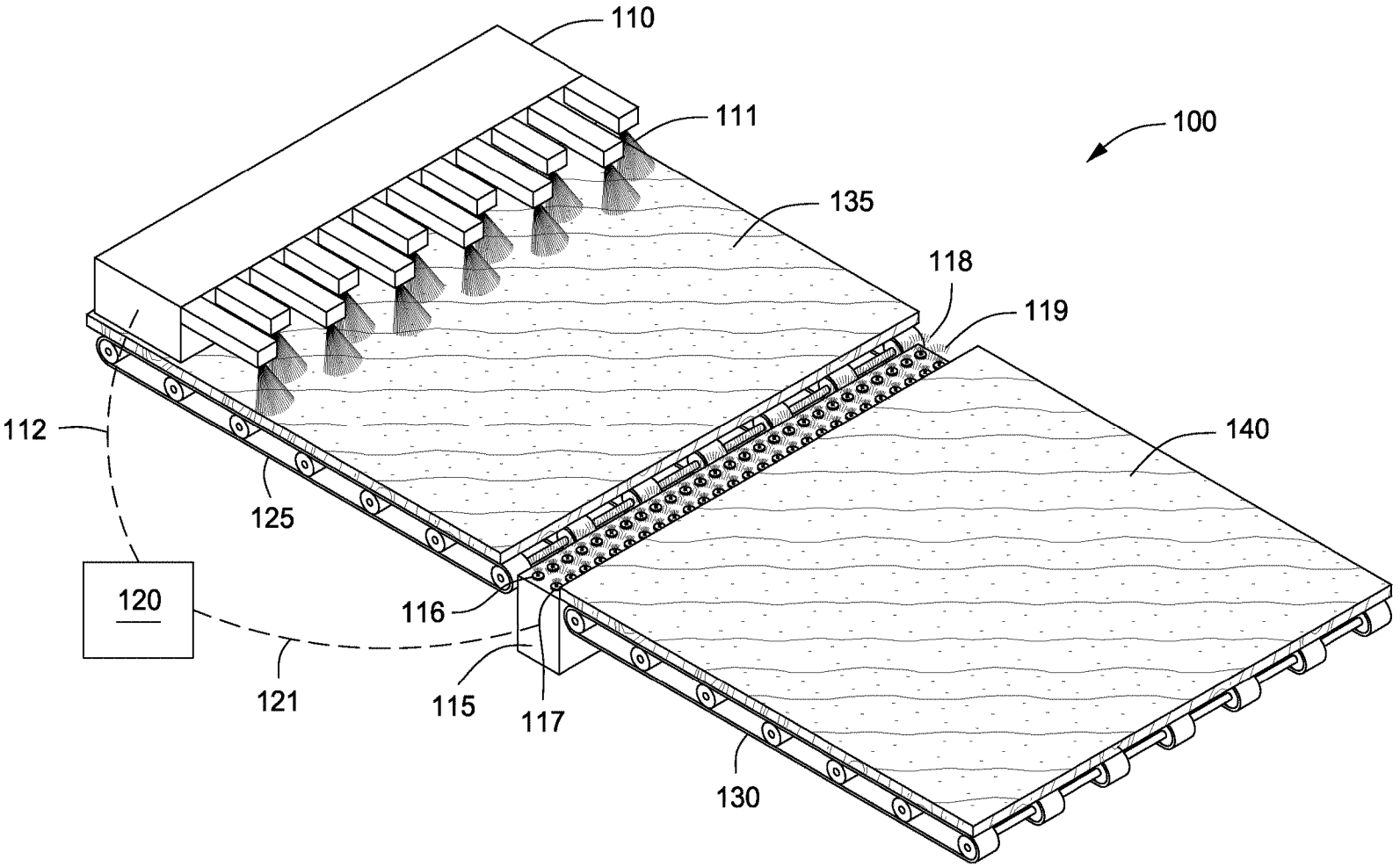
100
110
111
135
118
119
140
130
117
115
116
121
125
120
112

SYSTEMS AND METHODS FOR ADJUSTING MOISTURE CONCENTRATION OF A VENEER

CROSS-REFERENCE TO RELATED APPLICATION

This application is a Divisional Application of co-pending U.S. patent application Ser. No. 13/480,092, filed on May 24, 2012, which claims the benefit of U.S. Provisional Application No. 61/490,088, filed May 26, 2011, each of which is hereby incorporated by reference in its entirety.

BACKGROUND

Field

Embodiments described herein generally relate to systems and methods for adjusting a concentration of moisture of a veneer. More particularly, such embodiments relate to systems and methods for producing a veneer having a moisture concentration above a minimum moisture concentration level.

Description of the Related Art

Veneer products, e.g., plywood, laminate veneer lumber (LVL), laminated veneer boards (LVB), and the like, are produced by bonding a plurality of veneers (or one or more veneers and a core substrate) together with an adhesive and curing the adhesive to form the veneer product. The moisture concentration of the veneer upon skiving, cutting, slicing, sawing, or otherwise removing from a wood source or body such as a log typically ranges from about 60 wt % to about 170 wt %, based on a dry weight of the veneer. Prior to adhering the veneers to one another and/or to a core substrate, the veneers are dried in order to reduce the moisture concentration to a desired level, e.g., less than about 40 wt % moisture, before applying the adhesive and bonding the veneers to one another. Various techniques for drying the veneers have been developed, e.g., heating in an oven, contacting with a stream of hot air, air drying, and other methods, in order to reduce the moisture content to the desired level. The adhesive is applied to one or more surfaces of the dried veneers, the veneers are properly oriented with respect to one another, placed into contact with one another, and the adhesive is at least partially cured, usually under pressure and heat, to produce the veneer product.

Drying the veneer, however, typically does not produce veneers having uniform moisture concentration. Instead, the moisture concentration about a particular veneer, as well as the moisture concentration between different veneers, will usually vary. In fact, the moisture content about the surface of any given veneer can range anywhere from none, i.e., completely dry, up to about 40% moisture or more, based on the dry weight of the veneer, depending on the particular location about the veneer. As such, different locations or regions about a particular veneer can range from having no moisture to up to about 40%, based on the dry weight of the veneer, after drying. Adhering veneers that do not have a desired moisture concentration, e.g., fall below a minimum moisture concentration, results in poor bonding between the veneer(s) or the veneer and a core substrate.

In order to counteract the poor bonding between a veneer having a moisture concentration below a certain minimum level and another veneer or a core substrate, an increased amount of adhesive is typically applied to the substrate and/or the veneer. The increased amount of adhesive helps to reduce the negative effects caused by low moisture concentration in the veneer. In addition to the increased costs associated with the increased amount of adhesive used to produce the veneer product other negative effects can also be experienced. There is a need, therefore, for improved systems and methods for producing a veneer having a moisture concentration above a minimum moisture concentration level.

SUMMARY

Systems and methods for adjusting a moisture concentration of a veneer and products therefrom are provided. In at least one specific embodiment, the method for adjusting a moisture concentration of a veneer can include estimating a moisture concentration of a veneer surface at one or more locations thereon. The method can also include comparing the one or more estimated locations to a minimum moisture concentration level. The method can also include moisturizing at least a portion of the one or more estimated locations that are below the minimum moisture concentration level to increase the moisture concentration thereof.

In at least one other specific embodiment, the method for adjusting a moisture concentration of a veneer can include estimating a moisture concentration about a surface of at least a first veneer and a second veneer at a plurality of locations. The method can also include determining which of the plurality of estimated moisture concentration locations are below a minimum moisture concentration level. The method can also include contacting at least a portion of the locations that are below the minimum moisture concentration level with a liquid to increase the moisture concentration thereof to produce a first and second veneer product.

In at least one specific embodiment, the system for adjusting a moisture concentration of a veneer can include a moisture estimation system for estimating a moisture concentration of a veneer surface at one or more locations thereon. The system can also include a control system for comparing the one or more estimated locations to a minimum moisture concentration level. The system can also include a re-wet system for moisturizing at least a portion of the one or more estimated locations that are below the minimum moisture concentration level to increase the moisture concentration thereof.

In at least one other specific embodiment the method for adjusting a moisture concentration of a veneer can include estimating a moisture concentration about a plurality of locations on a surface of a veneer to provide a plurality of estimated moisture concentration locations. At least a portion of the plurality of estimated moisture concentration locations can be compared to one another to provide at least a first set and a second set of estimated moisture concentration locations, wherein the first set comprises locations having a first average moisture concentration and the second set comprises locations having a second average moisture concentration, and wherein the second average moisture concentration is less than the first average moisture concentration. At least a portion of the second set of estimated moisture concentration locations can be moisturized to produce a veneer product having a more uniform moisture concentration as compared to the veneer before moisturizing at least a portion of the second set of estimated moisture concentration locations, wherein moisturizing the at least a portion of the second set of estimated moisture concentration locations comprises contacting the veneer with an atomized liquid.

In at least one other specific embodiment, the system for adjusting a moisture concentration of a veneer can include a moisture estimation system for estimating a moisture concentration of a veneer surface at one or more locations thereon. The system can also include a control system for comparing at least a portion of the plurality of estimated moisture concentration locations to one another to provide at least a first set and a second set of estimated moisture concentration locations, wherein the first set comprises locations having a first average moisture concentration and the second set comprises locations having a second average moisture concentration, and wherein the second average moisture concentration is less than the first average moisture concentration. The system can also include a re-wet system for moisturizing at least a portion of the second set of estimated moisture concentration locations to produce a veneer product having a more uniform moisture concentration as compared to the veneer before moisturizing at least a portion of the second set of estimated moisture concentration locations, wherein moisturizing the at least a portion of the second set of estimated moisture concentration locations comprises contacting the veneer with an atomized liquid.

BRIEF DESCRIPTION OF THE DRAWINGS

FIG. 1 depicts an illustrative system for estimating a moisture concentration of a veneer and increasing the moisture concentration at selected locations thereabout, according to one or more embodiments described.

DETAILED DESCRIPTION

The moisture concentration of one or more veneers can be estimated at one or more locations, areas, or regions. As used herein, the terms "estimate," "estimated," and "estimating" refer to measuring, determining, assessing, quantifying, or otherwise evaluating the moisture concentration of the veneer at one or more locations, areas, or regions thereof. As used herein, the term "veneer" refers to a layer or sheet of wood. The layer or sheet of wood or "veneer" can have a thickness ranging from a low of about 0.8 mm, about 0.9 mm, about 1 mm, about 1.1 mm or about 1 2 mm to a high of about 3 mm, about 4 mm, about 5 mm, about 6 mm, about 7 mm, about 8 mm, about 9 mm, or about 10 mm. For example, the thickness of the veneer can range from about 1.3 mm to about 6.5 mm, about 1.4 mm to about 6 mm, about 1.5 mm to about 5 mm, about 2 mm to about 6 mm thick, about 2.5 mm to about 4.5 mm thick, or about 3 mm to about 5 mm. In another example the veneer can have a thickness of at leas 0.8 mm, at least 0.9 mm, at least 1 mm, at least 1.1 mm or at least 1.2 mm and up to a high of about 3 mm, about 4 mm, about 5 mm, about 6 mm, about 7 mm, about 8 mm, about 9 mm, or about 10 mm.

The moisture concentration of the veneer can be estimated at a single location or at two or more locations. For example, the moisture concentration of the veneer can be estimated at, on, or otherwise about a first side or surface of the veneer. The moisture concentration of the veneer can be estimated at two or more locations, i.e., a plurality of locations. For example, the first side of the veneer can be divided, segregated, or otherwise apportioned into two or more locations and the moisture concentration can be estimated at one or more of the two or more locations. In another example, the first side of the veneer can be divided, segregated, or otherwise apportioned into two or more locations and the moisture concentration can be estimated at two or more of the two or more locations.

The one or more locations at which the moisture concentration of the veneer is estimated can have any desired shape or combination of shapes. One particular division or apportionment of the veneer into the one or more locations can be to divide the first side into a grid-like pattern. For example, a veneer having a rectangular shape can be divided into one or more areas or regions, e.g., rectangular areas, which can abut or border one another. As such the moisture concentration about most or all the surface of a veneer can be collectively covered within one of the divided areas. For example, the combined surface area of the one or more locations can account for about 60% or more, about 65% or more, about 70% or more, about 75% or more about 80% or more about 85% or more about 90% or more about 95% or more, about 97% or more, about 98% or more, about 99% or more, about 99.9% or more, or about 100% of the total surface area of the first side of the veneer.

Preferably, the veneer can be divided into a grid-like pattern with each of the one or more locations having a rectangular area. For example, the rectangular areas can have a width ranging from a low of about 1 cm, about 2.5 cm, or about 5 cm to a high of about 10 cm, about 20 cm, about 30 cm, about 40 cm, about 50 cm, about 60 cm, or about 65 cm and a length ranging from a low of about 5 cm, about 10 cm, about 15 cm, about 20 cm, or about 25 cm to a high of about 50 cm, about 75 cm, about 100 cm, about 150 cm, about 200 cm, or about 250 cm. In another example, the rectangular areas can have a width ranging from about 1.5 cm to about 5 cm an a length ranging from about 5 cm to about 25 cm. The surface of the veneer can be divided into any other shape or combination of shapes to provide the one or more locations. Suitable shapes can include, but are not limited to, rectangles, triangles, circles, pentagons, hexagons, and the like.

Each individual location at which the moisture concentration is estimated can be the same size or different sizes with respect to one another. For example, the size of each location at which the moisture concentration is estimated can be about the same size with respect to one another. The particular area or size of each location can depend, at least in part, on the size of the veneer and can widely vary. For example, the area or size of each location at which the moisture concentration is estimated can range from a low of about 1 $cm^2$, about 5 $cm^2$, about 10 $cm^2$, about 15 $cm^2$, about 20 $cm^2$ or about 25 $cm^2$ to a high of about 100 $cm^2$, about 1,000 $cm^2$, about 2,500 $cm^2$, about 5,000 $cm^2$, about 10,000 $cm^2$, about 20,000 $cm^2$, or about 30,000 $cm^2$. In another example, the area or size for each location at which the moisture concentration can be estimated can range from about 6 $cm^2$ to about 150 $cm^2$, about 20 $cm^2$ to about 100 $cm^2$, about 6 $cm^2$ to about 250 $cm^2$, about 50 $cm^2$ to about 300 $cm^2$, or about 60 $cm^2$ to about 200 $cm^2$. In another example, the area or size of each location at which the moisture concentration can be estimated can be about 1 $cm^2$, about 3 $cm^2$, about 6.5 $cm^2$, about 15 $cm^2$, about 30 $cm^2$, about 60 $cm^2$, about 120 $cm^2$, about 300 $cm^2$, about 500 $cm^2$, about 1,000 $cm^2$, about 2,000 $cm^2$, or about 5,000 $cm^2$.

Depending on the particular system, device, or combination of systems and/or devices used to estimate the moisture concentration about the veneer, another suitable way of dividing the veneer, e.g., the first side of the veneer, into the one or more locations can use a coordinate system. Such a coordinate system can be similar to a grid-like pattern except that localized or specific points can be assigned rather than a localized region or area. For example, an X-Y coordinate system can be used to assign one or more locations with a particular X-Y coordinate value. The coordinate values can be distributed about the surface of the veneer in any desired manner. For example, a number of locations located an equal distance from one another, an unequal distance from one another, or a combination thereof can be formed. In another example, the moisture concentration of the veneers can be estimated in such a manner that continuous moisture concentration maps can be produced and evaluated. Such a continuous moisture concentration map can be divided into the one or more locations, regions, or areas, the one or more of X-Y coordinate values, or the like.

When estimating the moisture concentration of the veneer, one or more properties of the veneer can be taken into account in order to produce the estimated moisture concentration at the one or more locations. Illustrative veneer properties that can be considered when estimating the moisture concentration thereof can include, but are not limited to, the thickness of the veneer, the type and/or age of tree the veneer was produced from, the average size of the wood grains of the veneer, or any combination thereof.

The particular concentration of moisture at one or more of the estimated locations can be used to estimate, determine, assess, or otherwise evaluate whether or not the moisture concentration at a given location falls below a predetermined or minimum moisture concentration level. The minimum moisture concentration level can be any desired moisture concentration level. The minimum moisture concentration level can be based, at least in part, on one or more factors or variables. Illustrative factors or variables can include, but are not limited to, the particular adhesive(s) used to join the veneers to one another and/or to a core substrate, the particular wood from which the veneer is made, the thickness of the veneer, and the like.

The minimum moisture concentration level for any one or more of the one or more locations can be about 4 wt %, about 5 wt %, about 6 wt %, about 7 wt %, about 8 wt %, about 9 wt %, about 10 wt %, about 11 wt %, about 12 wt %, about 13 wt %, about 14 wt %, about 15 wt %, about 16 wt %, about 17 wt %, about 18 wt %, about 19 wt %, or about 20 wt %, based on the dry weight of the veneer at the particular location. In another example, the minimum moisture concentration level for any one or more of the one or more locations can be about 5.5 wt %, about 6.5 wt %, about 7.5 wt %, about 8.5 wt %, about 9.5 wt %, about 10.5 wt %, about 11.5 wt %, about 12.5 wt %, about 13.5 wt %, about 14.5 wt %, about 15.5 wt %, about 16.5 wt %, about 17.5 wt %, about 18.5 wt %, about 19.5 wt %, or about 20.5 wt %, based on the dry weight of the veneer at the particular location. In another example, the minimum moisture concentration level for any one or more of the one or more locations can be greater than 4 wt %, greater than 5 wt %, greater than 6 wt %, greater than 7 wt %, greater than 8 wt %, greater than 9 wt %, or greater than 10 wt %, greater than 12 wt %, greater than 14 wt %, greater than 16 wt %, greater than 18 wt %, or greater than 20 wt %, based on the dry weight of the veneer at the particular location. In another example, the minimum moisture concentration level for any one or more of the one or more locations can be greater than 5.5 wt %, greater than 6.5 wt %, greater than 7.5 wt %, greater than 8.5 wt %, greater than 9.5 wt %, greater than 10.5 wt %, greater than 11.5 wt %, greater than 12.5 wt %, greater than 13.5 wt %, greater than 14.5 wt %, greater than 15.5 wt %, greater than 16.5 wt %, greater than 17.5 wt %, greater than 18.5 wt %, greater than 19.5 wt %, or greater than 20.5 wt %, based on the dry weight of the veneer at the particular location.

When the one or more locations include two or more locations, the minimum moisture concentration level for any two of the one or more locations can be the same. For example, the minimum moisture concentration level can be about 5 wt % or more or about 7 wt % or more or about 8 wt % or more, based on the dry weight of the veneer, for all the locations. In other words, the entire veneer can have the same minimum moisture concentration level. In another example, when the one or more locations include two or more locations, the minimum moisture concentration level for any two of the one or more locations can be different, with respect to one another. For example, the minimum moisture concentration level can be about 7 wt % or more, based on the dry weight of the veneer, at one or more locations and about 10 wt % or more, based on the dry weight of the veneer, at one or more other locations.

In another example, the particular concentration of moisture at one or more locations can be used to estimate, determine, assess, or otherwise evaluate the moisture concentration about the veneer at a particular location, region, or area of the veneer. For example, the particular concentration of moisture at two or more locations can be estimated and compared to one another. Based on the compared estimated moisture concentrations the veneer can be moistened thereabout to produce a veneer having a more uniform moisture concentration distribution. For example, the moisture concentration of a veneer can be estimated at a plurality of locations, at least a portion of the plurality of locations can be compared to one another to provide at least a first set and a second set of estimated moisture concentration locations. The first set can include locations having a first average moisture concentration and the second set can include locations having a second average moisture concentration, with the first and second average moisture concentrations differing from one another. For example, the second average moisture concentration can be less than the first average moisture concentration. At least a portion of the second set of locations can be moistened to produce a moistened veneer or veneer product having a more uniform moisture concentration therethrough and/or thereabout. Any two or more of the second set of locations that can be moistened can be moistened by contacting or otherwise applying the same amount of liquid or different amounts of liquids thereto. The veneer product having a more uniform moisture concentration level can also have a moisture concentration level above the predetermined minimum moisture concentration level.

If it is desired to produce a moistened veneer or veneer product having a more uniform moisture concentration as compared to the same veneer prior to moistening at least a portion of the estimated moisture concentration locations, the veneer product can have a moisture concentration that varies by less than about 20%, less than about 15%, less than about 10%, less than about 5%, less than about 3%, or less than about 1% between any two given areas, locations, or regions about the veneer. For example, a veneer product having a more uniform moisture concentration in which the moisture concentration varies by about 20% and has an average moisture concentration of about 15 wt %, based on the dry weight of the veneer, can have a moisture concentration at any particular location ranging from about 12 wt % to about 18 wt %, based on the dry weight of the veneer at the particular location. In another example, a veneer product having a more uniform moisture concentration in which the moisture concentration varies by about 5% and has an average moisture concentration of about 15 wt %, based on the dry weight of the veneer, can have a moisture concentration at any particular location ranging from about 14.25 wt % to about 15.75 wt %, based on the dry weight of the veneer at the particular location. The veneer product having a more uniform moisture concentration can have an average moisture concentration ranging from a low of about 1 wt %, about 3 wt %, about 5 wt %, about 7 wt %, or about 9 wt % to a high of about 15 wt %, about 20 wt %, about 25 wt %, about 30 wt %, about 35 wt %, or about 40 wt %. The veneer product having a more uniform moisture concentration ranging anywhere from about 1 wt % to about 40 wt % can have a moisture concentration between any two give areas, locations, or regions about the veneer of less than about 20%, less than about 15%, less than about 10%, less than about 5%, less than about 3%, or less than about 1%, with respect to one another.

Any suitable system, device, or combination of systems and/or devices can be used to estimate the moisture concentration of the veneer. Illustrative techniques for estimating the moisture concentration about the veneer can include, but are not limited to, one or more electrical sensors in contact with the first side of the veneer as the veneer moves past the electrical sensor(s), one or more light sources for transmitting light through the veneer and one or more light detectors for sensing the light transmitted through the veneer, interaction of radio frequency signals with the veneer, a radiant energy source directed toward the veneer and a temperature sensor configured to estimate a temperature rise in response to the radiant energy, infrared radiation and detector, neutron beam and detector, or any combination thereof. Preferably the moisture concentration of the veneer is estimated via the one or more electrical sensors, e.g., one or more conductive brushes or other contacts, that can be distributed across a width or length of the veneer and contact the first side of the veneer as the veneer passes by the electrical sensors. Suitable systems and methods for estimating the moisture concentration about the veneer can include, but are not limited to, those discussed and described in U.S. Pat. Nos. 3,748,578; 6,974,035; 4,683,418; 4,612,802; and 7,068,050. A commercially available system suitable for estimating the moisture concentration of the veneer can be the Sequoia Sentry system available from Ventek.

When the estimated moisture concentration of one or more of the locations falls below the minimum moisture concentration level, at least a portion of the one or more locations can be contacted with one or more liquids to increase the moisture concentration at those locations to be about equal to, equal to, or above the minimum moisture concentration level. In other words, the particular location(s) that fall below the minimum moisture concentration level can be selectively contacted with a liquid to increase the moisture concentration of the veneer at that particular location(s) to be about equal to, equal to, or above the minimum moisture concentration level.

Any suitable liquid can be used to contact the veneer at the one or more locations falling below the minimum moisture concentration level. For example, the liquid can be or include water. In another example, the liquid can be or include, but is not limited to, water, hydrocarbons such as methanol, ethanol, propanol, or any combination thereof. The liquid can also include one or more additives. Illustrative additives can include, but are not limited to, dispersants, biocides, viscosity modifiers, pH adjusters, coupling agents, surfactants, lubricants, defoamers, or any combination thereof.

The liquid contacted with the veneer can be directed, applied, or otherwise contacted therewith in any suitable form and in any suitable manner. For example, the liquid can be sprayed, dripped, coated, brushed, rolled, poured, or otherwise directed toward the veneer at the desired location(s) such that the liquid is contacted therewith. The liquid contacted with the veneer can be in the form of a continuous or intermittent liquid stream, droplets such as a mist, fog, atomized liquid, or the like. Preferably, the liquid contacted with the veneer is atomized. In other words, the liquid contacted with the veneer can be in the form of atomized droplets.

Contacting the veneer at the one or more locations that fall below the minimum moisture concentration level with atomized liquid can improve the penetration or dispersion of the liquid into the veneer. The atomized liquid can have an average droplet size ranging from a low of about 1 μm, about 5 μm, about 10 μm, about 20 μm, or about 30 μm to a high of about 100 μm, about 150 μm, about 200 μm, about 250 μm, or about 300 μm. For example, the atomized liquid can have an average droplet size of less than about 200 μm, less than about 150 μm, less than about 100 μm, less than about 90 μm, less than about 80 μm, or less than about 50 μm. In another example, the atomized liquid can have an average droplet size ranging from about 10 μm to about 100 μm, about 30 μm to about 70 μm, about 20 μm to about 80 μm, about 40 μm to about 60 μm, or about 25 μm to about 75 μm. The droplet size or average droplet size of the atomized liquid can be estimated or measured in accordance with ASTM E1260-03 (2009).

Any suitable system, device, or combination of systems and/or devices can be used to produce the atomized liquid. The liquid can be atomized via pressure atomization, air atomization, centrifugal atomization, electrostatic atomization, ultrasonic atomization, or any combination thereof. For example, the liquid, under pressure, can be passed through a nozzle or other device to produce the atomized liquid. In another example, the liquid can be passed through a nozzle or other device at low speed and can be surrounded by a high speed stream of air, steam, and/or other fluids and friction between the air and liquid can cause atomization of the liquid. In another example, the liquid can be mixed with a gas to provide a liquid/gas mixture. The liquid/gas mixture can be passed through a nozzle or other device to produce the atomized liquid. In another example, the liquid can be passed through a nozzle or other device(s) and the liquid can be mixed within the nozzle and/or upon exiting the nozzle with a gas to produce the atomized liquid. In another example, the liquid can be passed through a nozzle or other device and the liquid can be mixed within the nozzle and/or upon exiting the nozzle with two or more gas streams, e.g., three streams of atomization air can be contacted with the liquid at three different angles, to produce the atomized liquid. Suitable gases for mixing with the liquid can include, but are not limited to, air, nitrogen, carbon dioxide, argon, steam, or any combination thereof. In yet another example, a liquid can be introduced via a nozzle or other device to a center of a spinning body such as a cup or disk. Centrifugal force can carry the liquid to the edge of the disk and the liquid can be ejected or urged off the disk. Upon leaving the disk the liquid can be broken into atomized droplets. In still another example, the liquid can be exposed to an intense electric field between a charged atomizer and a grounded work piece. The charge can be transferred to the liquid and repulsive forces between an atomizer and the liquid can separate droplets from the atomizer and send them toward the veneer. In still another example, the liquid can pass over a vibrating surface of an electromechanical device. The vibrating surface can cause the liquid to break into atomized droplets.

The atomized liquid can be ejected or otherwise emitted from one or more nozzles or other devices. The apparatus, system, or device having the one or more nozzles for ejecting the liquid, atomized or in any other form, can be referred to as a re-moisturizing system or re-wet system. The nozzles can be located, distributed, or otherwise positioned such that atomized liquid can be ejected from each nozzle and contacted with the veneer at a localized area or region. Collectively, the nozzles can be used to contact the veneer with the liquid across the width or length of the veneer. For example, after estimating the moisture concentration of the veneer, the veneer can pass across or otherwise by the nozzles and ejection of the atomized liquid from the nozzles can be timed such that the liquid contacts the particular location(s) having a moisture concentration below the minimum level. As such, the entire surface of the veneer or only selected portions thereof can be contacted with the liquid to increase the moisture concentration of the veneer as desired.

A particular arrangement for the nozzles can be to align the nozzles, with respect to one another, in one or more rows. For example, the re-wet system can include 1, 2, 3, 4, 5, or more rows of nozzles, with the nozzles in each row aligned with one another. The number of nozzles in each row can be the same or different with respect to one another. For example, one or more rows of nozzles can include anywhere from a low of about 2, about 5, about 10, or about 15 nozzles to a high of about 25, about 50, about 75, or about 100 nozzles. The particular number of nozzles in each row can be based, at least in part, on the width or length of the veneer to be rewetted by the liquid ejected from the nozzles. In one example, if the veneer has a length of about 2.4 m and the veneer is oriented such that the nozzles span the length of the veneer, the rewet system can include about 25 to about 30 nozzles, e.g., 27 nozzles. In another example, if the veneer has a width of about 1.2 m and the veneer is oriented such that the nozzles span the width of the veneer, the rewet system can include about 10 to about 15 nozzles, e.g., 14 nozzles.

In at least one specific example, the rewet system can include one, two, three, four or more rows of nozzles, with each row having about 10 to about 15 or about 25 to about 30 nozzles. In a re-wet system having a first row of nozzles and a second row of nozzles, the first row of nozzles can be aligned with the second row of nozzles or first row of nozzles can be staggered with respect to the second row of nozzles.

Configuring the re-wet system to include two or more rows of nozzles can be one way to increase the particular amount of liquid contacted with any one or more particular locations. For example, a first row of nozzles can be a "primary" liquid source for contacting the veneer with the liquid. Any subsequent row(s) can be referred to as a "secondary" or "back-up" liquid source for contacting the veneer with the liquid. As such, if one or more of the nozzles in the primary row of nozzles does not emit sufficient liquid therefrom for a particular location, the secondary liquid source, e.g., the corresponding nozzle in the second row, can be actuated to emit liquid toward the particular location thereby further increasing the amount of liquid contacted with that particular location.

The veneer can pass any desired distance from the nozzles that emit the liquid therefrom. For example, the distance between the nozzles and the veneer passing by the nozzles can range from a low of about 1 cm, about 2.5 cm, about 5 cm, or about 7 cm to a high of about 15 cm, about 20 cm, about 25 cm, about 35 cm, or about 50 cm. For example, the distance between the nozzles and the surface of the veneer can be about 2 cm to about 40 cm, about 5 cm to about 25 cm, about 10 cm to about 20 cm, about 4 cm to about 30 cm, or about 3 cm to about 25 cm.

The nozzles can be fixed, moveable, or one or more nozzles can be fixed and one or more nozzles can be moveable relative to a body or housing of the rewet system. For example, all or one or more of the nozzles can remain in a stationary position relative to the rewet system. In another example, all or one or more of the nozzles can move relative to the body or housing of the rewet system. Although discussed in the context of the veneer moving relative to the nozzles, i.e., the nozzles can be fixed or stationary, the nozzles can be moved relative to the veneer. In still another example, both the veneer and the nozzles can move relative to one another. For example, the nozzles can be moved toward and away from the veneer to adjust a distance between the veneer and the nozzles while the veneer passes by the nozzles. In another example, the nozzles can be moved about an X-Y coordinate relative to the surface of the veneer while the veneer is stationary or while the veneer passes the nozzles.

Each nozzle can be independently actuated or otherwise switched between an "off" position or state and an "on" position or state with respect one another. As such, the veneer can be contacted with liquid at only the locations or substantially only the locations having a moisture concentration below the minimum level. Some overlap or overspray of liquid onto the veneer at locations not falling below the minimum moisture concentration can be expected under certain conditions and can also be acceptable.

When the nozzles are in the off position, no liquid is emitted therefrom. When the nozzles are in the on position, a constant, set, or fixed amount of liquid can be emitted therefrom. In other words, the amount of liquid emitted from the nozzles can be constant or fixed when in the on position. In another example, the amount of liquid emitted from the nozzles when in the on position can be variable or adjustable. When the nozzles are in the on position, the amount of liquid ejected or otherwise emitted from each nozzle that emits a fixed amount of liquid therefrom can range from a low of about 0.035 L/min, about 0.18 L/min, about 0.37 L/min, about 0.55 L/min, or about 0.75 L/min to a high of about 1.5 L/min, about 1.75 L/min, about 2 L/min, or about 2.5 L/min. For nozzles capable of adjusting or varying the amount of liquid emitted, the amount of liquid emitted therefrom can range from a low of about 0.035 L/min, about 0.18 L/min, about 0.37 L/min, about 0.55 L/min, or about 0.75 L/min to a high of about 1.5 L/min, about 1.75 L/min, about 2 L/min, or about 2.5 L/min. In another example, the amount of liquid emitted from the each nozzle, whether constant or variable, can be about 0.17 L/min, about 0.38 L/min, about 0.57 L/min, about 0.75 L/min, or about 1 L/min. The total amount of liquid emitted from the re-wet system, i.e., all of the nozzles combined, can range from a low of about 1 L/min, about 1.5 L/min, about 2 L/min, about 4 L/min, about 6 L/min, about 8 L/min, or about 10 L/min to a high of about 25 L/min, about 30 L/min, about 40 L/min, about 50 L/min, about 60 L/min, about 70 L/min, or about 80 L/min. For example, the total amount of liquid emitted from the re-wet system can range from about 20 L/min to about 40 L/min, about 25 L/min to about 35 L/min, about 5 L/min to about 20 L/min, or about 15 L/min to about 45 L/min.

The pressure of the liquid supplied to the nozzles can range anywhere from about 13.5 kPag (about 2 psig) to a high of about 1,400 kPag (about 200 psig). When the liquid emitted from the nozzles is atomized, however, the particular atomization process that produces the atomized liquid can reduce the pressure at which the atomized liquid is ejected or emitted from the nozzles. For example, the atomized liquid can exit the nozzles at a pressure ranging from a low of about 3.5 kPag (about 0.5 psig), about 6.9 kPag (about 1 psig), or about 13.5 kPag (about 2 psig) to a high of about 34.5 kPag (about 5 psig), about 70 kPag (about 10 psig), or about 103 kPag (about 15 psig).

The average temperature of the veneer can be estimated prior to, during, or after the moisture concentration is estimated at the one or more locations thereof. The temperature of the liquid can be adjusted such that the temperature of the liquid is within about 20%, about 15%, about 10%, about 5%, about 3%, about 2%, or about 1% of the average temperature of the veneer. Typical temperatures of the veneer can range from about 35° C. to about 60° C. As such, when a typical veneer is contacted with the liquid, the temperature of the liquid can range anywhere from about 28° C. to about 72° C. The temperature of the liquid can range from a low of about 28° C., about 35° C., or about 40° C. to a high of about 60° C., about 70° C., or about 75° C. In one example, the temperature of the liquid can be within about 10% of the average temperature of the veneer. In another example, the temperature of the liquid can be within about 5% of the average temperature of the veneer.

Illustrative apparatus and methods for producing atomized liquids can include, but are not limited to, those discussed and described in U.S. Pat. Nos. 5,934,555; 6,045,058; 6,460,775; 6,699,365; 6,869,031; and 6,962,296; and U.S. Patent Application Publication Nos.: 2003/0094254; 2004/0016828; and 2004/0074981.

The liquid contacted with the veneer at the one or more locations falling below the minimum moisture concentration level can be directed toward the same side that the moisture concentration was estimated, e.g., the first side. In another example, the liquid contacted with the veneer at the one or more locations falling below the minimum moisture concentration level can be directed toward a side that opposes the side the moisture concentration was estimated, e.g., a second side opposed to the first side. In another example, the liquid contacted with the veneer at the one or more locations falling below the minimum moisture concentration level can be directed toward both the side that the moisture concentration was estimated and the opposing side, e.g., the first side and the second side. In other words, the re-wet system can include nozzles directed toward both the first and second sides of the veneer.

A typical veneer can have different surface morphologies or topographies depending on the particular side of a given veneer. For example, a first side and an opposing second side of a veneer can have different surface morphologies or topographies with respect to one another. Typically veneer produced from a wood source can have a "tight" side and a "loose" side. The "tight" side includes wood grains that are more closely packed or located together than the wood grains of the "loose" side. The "loose" side of the veneer is the side contacted with a lathe knife or other cutting surface. Consequently, the "loose" side can have a more diverse topography that the "tight" side due to failures and/or checking that occurs during the formation of the veneer, which increase the surface area of the "loose" side as compared to the "tight" side. This increased surface area can enhance moisture absorption as compared to the "tight" side. Accordingly, in one example it can be preferable to contact the "loose" side with the liquid in order to improve penetration or dispersion of the liquid into the veneer, thus increasing the amount of moisture absorbed or otherwise incorporated into the veneer. In another example, it can be preferable to contact the "tight side" with the liquid in order to reduce the degree to which the liquid penetrates or disperses into the veneer. For example, if the moisture concentration of the veneer at a particular location is relatively close to the minimum moisture level, directing the liquid to the "tight" side at that particular location can increase the moisture concentration thereof, while helping maintain the increase in moisture concentration resulting from the additional liquid added thereto from exceeding a maximum moisture concentration, if such maximum moisture concentration exists. In another example, it can be preferable to contact both the "loose" side and the "tight" side of the veneer with the liquid in order to increase the moisture concentration thereof.

As mentioned above, a maximum moisture concentration of the veneer can also be used in conjunction with the minimum moisture concentration of the veneer. For example, the maximum moisture concentration can be used with the minimum moisture concentration if the particular veneer product and/or the particular adhesive(s) used to produce the veneer product yield an improved finished product and/or an improved process of producing the finished product when the moisture concentration of the veneer not only falls at or above the minimum moisture concentration, but also falls below the maximum moisture concentration. Illustrative minimum and maximum ranges can be, for example, about 5 wt % or more and about 40 wt % or less, about 7 wt % or more and about 40 wt % or less, about 7 wt % or more and about 30 wt % or less, based on the dry weight of the veneer. In another example, the minimum moisture concentration level can be about 5 wt %, about 7 wt %, about 9 wt %, about 10 wt %, about 11 wt %, or about 12 wt % and the maximum can be about 15 wt %, about 20 wt %, about 25 wt %, about 30 wt %, about 35 wt %, or about 40 wt %, based on the dry weight of the veneer.

The amount of liquid and the particular location(s) about the veneer to which the liquid can be applied can be determined manually, automatically, or both. Preferably the amount and location(s) of the liquid applied to the veneer is automatically determined. For example, a moisture estimation system used to estimate the moisture concentration of the veneer can be in communication with a control or analyzing system. The re-wet system can also be in communication with the control or analyzing system. The moisture estimation system and the re-wet system can be in communication with the same control system or different control systems. If the moisture estimation system and the re-wet system are in communication with different control systems, the different control systems can be in communication with one another.

The moisture concentration for the one or more locations estimated by the moisture estimation system can be input into the control system that can determine which of the estimated moisture concentration locations fall below the minimum moisture concentration level. The control system can communicate or signal to the re-wet system which nozzles should be actuated. The control system can also communicate or signal to the re-wet system the particular length of time each nozzle should be actuated to the on position. In addition to the moisture concentration of the one or more locations of the veneer, the control system can also evaluate other process variables or parameters. For example, the speed of the veneer as the veneer passes by the re-wet system can be taken into account. In another example, the speed of the re-wet system moving by or past the veneer can be taken into account.

The control system can include one or more processors, memory storage modules, and the like. For example, the control system can be or include one or more computers. The control system can accept or receive data or other information from the moisture estimation system and the re-wet system. The control system can also accept or receive data from other sources such as the speed of a conveyor belt or other device used to move the veneer.

Once the moisture concentration of the veneer has been estimated and the liquid has been contacted with the one or more locations falling below the minimum moisture concentration level, any number of processing steps can be taken. For example, the veneers can undergo a grading or classification process than groups the veneers according to desired properties, e.g., thickness, average moisture concentration, the type of wood the veneer is made from, number of defects in the veneer, and the like. In another example, the veneers can be subjected to grading prior to estimating the moisture concentration and contacting with the liquid as needed.

After contacting the one or more locations of the veneer with the liquid or after grading, if performed, the veneers can be allowed to sit or rest for a period of time in order to allow the moisture concentration within the veneer to equalize. For example, the veneers can be allowed to sit at room or atmospheric conditions for about 6 hours, about 12 hours, about 18 hours, about 24 hours, or more before being used to produce a veneer product.

After the desired length of rest, if performed, the veneer product can be produced by joining two or more veneers or one or more veneers to a core substrate. Applying the adhesive to the veneers can be carried out using any suitable system, device, or combination of systems and/or devices. For example, the adhesive can be sprayed, rolled, brushed, dipped, poured, misted, foamed onto, soaked, roll-spread, or otherwise applied to at least a portion of one or more surfaces of one or more veneer products. The adhesive can be applied to the veneer about one or more surfaces. The applied adhesive can cover at least one surface entirely or less than the entire surface can be covered.

For a finished product that includes a plurality of veneers joined to one another, the veneers can be properly oriented with respect to one another, contacted with one another, and the adhesive applied thereto can be at least partially cured to produce the finished product. For a finished product that includes one or more veneers joined to a core substrate, the veneer(s) and the core substrate can be properly oriented with respect to one another, contacted with one another, and the adhesive applied thereto can be at least partially cured to produce the finished product. At least partially curing the adhesive can include application of pressure and/or heat to the plurality of veneers and/or the one or more veneers and the core substrate. Conventional equipment and methods can be used to produce the finished veneer products, e.g., plywood and/or laminated veneer lumber, from the veneers.

The adhesives used in the production of laminated products can include any suitable adhesive or combination of adhesives. Illustrative adhesives can include, but are not limited to, amino-aldehyde resins, phenol-aldehyde resins, isocyanate-functional resins, isocyanate-functional resins modified with a soy protein, resorcinol-aldehyde resins, protein adhesives, combinations of protein(s) and cross-linkers such as isocyanates or quaternary amine or polymeric quaternary amines, soy crosslinked adhesives using polymeric or non-polymeric azetidinium functionality, lignin based adhesives, tannin based adhesives, or any combination thereof. Amino compounds suitable for use in the amino-aldehyde resins can include, but are not limited to, urea, melamine, or a combination thereof, e.g., melamine-urea-formaldehyde ("MUF"). The amino containing resins can also include phenol, e.g., phenol-urea-formaldehyde ("PUF") resins. Other amino containing resins can include phenol-melamine-urea-formaldehyde ("PMUF") resins. The aldehyde resins can be resole resins, novolac resins mixed or otherwise combined with one or more cross-linking agents, or a combination thereof. Suitable resins can include those discussed and described in U.S. Pat. Nos. 3,658,622; 3,931,070; 4,130,515; 4,915,766; 4,968,771; 5,106,697; 5,202,403; 6,369,171; 6,399,719; 7,736,559; 7,781,501 and U.S. Patent Application Publication Nos. 2005/0070635; 2005/0257888; 2005/0261404; 2006/0142433; 2006/0231968; 2006/0234077; 2007/0054144; 2008/0027159; 2010/0256289.

When the veneer product comprises only veneers joined to one another, the veneer product can include anywhere from 2 to about 50 veneers. For example, the number of veneers joined together to produce a plywood product can range from a low of about 2, about 5, or about 10 to a high of about 15, about 30, about 40, or about 50. In another example, the number of veneers jointed together to produce a plywood product can range from about 2 to about 10, about 3 to about 7, about 5 to about 15, or about 3 to about 12. When the veneer product comprises one or more veneers joined to a core substrate, the veneer product can also include anywhere from 2 to about 50 veneers joined to one another and/or to the core substrate. As used herein the term "core substrate" refers to a sheet or body having a greater thickness than the veneer, e.g., greater than about 10 mm. The core layer can be or include a plurality of particles such as a particle board, fiberboard, oriented strand board, and the like, solid wood, sheetrock, or the like.

The veneers can be produced using any suitable process. For example, the veneer can be produced by skiving, cutting, slicing, sawing, or otherwise removing a thin layer or sheet from a source of wood, e.g., a wood log. The wood from which the veneer is produced can be softwood or hardwood. The veneer product can include veneers made of one or more soft woods, one or more hard woods, or a combination of veneers made from softwood and hardwood. Such veneer products, in finished form, can include those products typically referred to as laminated veneer lumber (LVL) and/or plywood.

Depending, at least in part, on the particular veneer product that can incorporate the veneer(s), the veneers can have any suitable shape, e.g., rectangular, circular, or any other geometrical shape. Typically the veneers can be rectangular, and can have a width ranging from a low of about 1 cm, about 5 cm, about 10 cm, about 15 cm, about 20 cm, or about 25 cm to a high of about 0.6 m, about 0.9 m, about 1.2 m, about 1.8 m, or about 2.4 m. The veneers can have a length ranging from a low of about 0.3 m, about 0.6 m, about 0.9 m, about 1.2 m, or about 1.8 m to a high of about 2.4 m, or about 3 m, about 3.6 m, about 4.3 m, about 4.9 m, about 5.5 m, about 6.1 m, about 6.7 m, about 7.3 m, or about 7.9 m. For example, in a typical veneer product such as plywood, the veneers can have a width of about 1.2 m and a length of about 2.4 m. In another example, a typically plywood veneer product having a final dimension of about 1.2 m by about 2.4 m can be produced from veneers having larger dimensions that can be trimmed or cut to a desired size in order to produce the final plywood product.

FIG. 1 depicts an illustrative system 100 for estimating moisture concentration of a veneer 105 and increasing the moisture concentration at selected locations thereabout, according to one or more embodiments. The system 100 can include, but is not limited to, one or more moisture estimation systems 110, one or more re-wet systems 115, one or more control systems 120, and one or more conveyors (two are shown 125, 130). As shown, the moisture estimation system 110 can include one or more conductive contacts (twelve are shown 111). The conductive contacts 111 can be in contact with a veneer 135 as the veneer 135 moves along the conveyor 125. The conductive contacts 111 can estimate the moisture concentration of the veneer as the veneer moves along the conveyor 125. The estimated moisture concentration of the veneer 135 can be communicated as data via line 112 to the control system 120.

The control system 120 can evaluate the estimated moisture concentration of the veneer 135 and can determine from the data provided via the moisture estimation system 110 which of the one or more locations have a moisture concentration below the minimum moisture concentration level. The conductive contacts 111 can estimate the moisture concentration of the veneer 135 in rectangular or substantially rectangular regions across the veneer 135, i.e., from a first end to a second end thereof. Based on the speed of the veneer 135 moving along the first conveyor 125, the control system 120 can divide or apportion the one or more rectangular regions into smaller rectangular regions thereby providing a plurality of estimated moisture concentration locations. Alternatively, the plurality of estimated moisture concentration locations can be the substantially rectangular regions running across the veneer 135 as estimated via conductive contacts 111 of the moisture estimation system 110.

The rectangular regions can have any desired width and/or any desired length. The rectangular regions can be the same size or different sizes with respect to one another. Two or more of the rectangular regions can be the same size with respect to one another and/or two or more of the rectangular regions can be different sizes with respect to one another. Illustrative dimensions and areas can be as discussed and described above. For example, the rectangular regions can have an area ranging anywhere from a low of about 1 $cm^2$, about 5 $cm^2$, about 10 $cm^2$, about 15 $cm^2$, about 20 $cm^2$ or about 25 $cm^2$ to a high of about 100 $cm^2$, about 1,000 $cm^2$, about 2,500 $cm^2$, about 5,000 $cm^2$, about 10,000 $cm^2$, about 20,000 $cm^2$, or about 30,000 $cm^2$. In another example, the area or size the rectangular regions can range from about 6 $cm^2$ to about 150 $cm^2$, about 20 $cm^2$ to about 100 $cm^2$, about 6 $cm^2$ to about 250 $cm^2$, about 50 $cm^2$ to about 300 $cm^2$, or about 60 $cm^2$ to about 200 $cm^2$. In another example, the rectangular regions can have a width ranging from a low of about 1 cm, about 2.5 cm, or about 5 cm to a high of about 10 cm, about 20 cm, about 30 cm, about 40 cm, about 50 cm, about 60 cm, or about 65 cm and a length ranging from a low of about 5 cm, about 10 cm, about 15 cm, about 20 cm, or about 25 cm to a high of about 50 cm, about 75 cm, about 100 cm, about 150 cm, about 200 cm, or about 250 cm. In another example, the rectangular areas can have a width ranging from about 1.5 cm to about 5 cm an a length ranging from about 5 cm to about 25 cm.

As shown, the conductive contacts 111 can be in the form of metal brushes and/or brushes formed of other conductive material. If the conductive contacts 111 include brushes, the brushes can each include a plurality of individual or semi-discrete bristles. For example, any one or more of the brushes can include anywhere from 1 to 10,000 or more individual bristles.

Conductive contacts 111 that include brushes having a plurality of bristles can fan or spread out at their respective contact points with the veneer 135. As such, the conductive contacts 111 can be alternatingly staggered with respect to one another in order to prevent contact between adjacent conductive contacts 111 and to also ensure complete coverage of the veneer 135. As shown, six conductive contacts 111 are aligned in one row and six conductive contacts 111 are aligned in another row with the two rows offset with respect to one another. The moisture estimation system 110 can have any number of rows of the conductive contacts 111 and the conductive contacts 111 can be staggered, aligned, or a combination thereof, with respect to one another. Any number of conductive contacts 111 can be aligned in the first and second rows. For example, the number of conductive contacts 111 in any particular row can range from a low of about 1, about 6, about 12, about 15, or about 20 to a high of about 25, about 30, about 35, about 40, about 45, or about 50. The total number of conductive contacts 111 can range from a low of about 2, about 6, about 10, about 16, about 20, about 24, or about 26 to a high of about 30, about 36, about 42, about 50, about 60, about 70, about 80, about 90, or about 100. In at least one specific example, the total number of conductive contacts 111 can range from about 12 to about 40, about 14 to about 36, about 18 to about 32, about 22 to about 26, or about 22 to about 24.

After estimating the moisture concentration of the veneer 135 with the moisture estimation system 110, the veneer 135 can pass the re-wet system 115. As shown, the veneer 135 can be transferred from the first conveyor 125 to the second conveyor 130 with the re-wet system 115 positioned between the first and second conveyors 125, 130. However, the first and second conveyors 125, 130 can be a single conveyor system with the liquid permitted to pass through the conveyor systems.

The re-wet system 115, as shown, can include two rows of nozzles 116, 117. As shown, each row includes 27 nozzles 116, 117. The two rows of nozzles 116, 117, however, can include any number of nozzles and the number of nozzles in each row can be the same or different with respect to one another. The first row of nozzles 116 can emit liquid 118 therefrom which can contact the veneer 135 at the desired locations. Similarly, the second row of nozzles 117 can emit liquid 119 therefrom which can also contact the veneer 135. Contacting the veneer 135 with the liquid 118 and/or 119, can produce a veneer product 137. The first row of nozzles 116 can also be referred to as at the "primary" liquid source and the second row of nozzles 117 can be referred to as the "secondary" liquid source. One or more of the nozzles in the second row of nozzles 117 can be used to direct additional liquid to particular locations when the amount of liquid emitted from the corresponding nozzle in the first row of nozzles 116 is not sufficient.

The control system 120 can communicate via line 121 with the re-wet system 115, which particular nozzles need to be actuated to the on position, at what time, and/or for how long, in order to direct the liquid 117 to the veneer 135 at the appropriate locations to produce a veneer product 140.

The communication via line 112 between the moisture estimation system 110 and the control system 120 can be via wireless connection and/or a physical connection. The communication via line 121 between the control system 120 and the re-wet system can be via wireless connection and/or a physical connection. Physical connections can include, but are not limited to, fiber optic cables, electrically conductive cables, fluid transmission lines such as pneumatic or hydraulic fluid transfer lines, and the like. Wireless connections can include, but are not limited to, transmission of electromagnetic signals, transmission of pneumatic signals, or any combination thereof. Electromagnetic signals can include, but are not limited to, radio waves, sound waves, microwaves, infrared radiation, visible light, ultraviolet radiation, X-rays, gamma rays, or any combination thereof. The communication via line 112 can be an analog or digital communication. The communication via line 121 can be an analog or digital communication. The communication via line 112 can include both analog and digital communications. The communication via line 121 can include both analog and digital communications.

The control system 120 can send and/or receive one or more signals via lines 112, 121 from the moisture estimation system 110 and the re-wet system 115, respectively, in any desired manner or form. For example, the signals via lines 112, 121 can be continuous, discontinuous, discrete, intermittent, or a combination thereof. The signals transmitted via lines 112 and 121 can be the same form or different form from one another. For example, a continuous stream or flow of data can be transmitted via line 112 between the moisture estimation system 110 and the control system 120 and a continuous stream or flow of data can be transmitted via line 121 between the control system 120 and the re-wet system 115. In another example, a discontinuous signal, e.g., a plurality of discrete signals, can be transmitted via line 112 between the moisture estimation system 110 and the control system 120 and a discontinuous signal can be transmitted via line 121 between the control system 120 and the re-wet system 115. In another example, one of the signals transmitted via lines 112 and 121 can be continuous and the other discontinuous.

The veneer product 140 can have a moisture concentration above the minimum moisture concentration level. As discussed and described above, the liquid 118 and/or 119 emitted from the first and second rows of nozzles 116, 117 can be in the form of atomized droplets. However, the liquid can also be delivered in other forms such as a continuous stream or spray, a mist, and the like.

The veneer product 140 after passing the re-wet system 115 and onto the second conveyor 130 can be further processed according to the particular process procedure of a given mill. For example, the veneer product 140 can be subjected to a veneer grading system. In another example, the veneer product 140 can be sent to a drying or "equalization" location where the veneer product 140 can sit for a period of time in order to allow the moisture concentration of the veneer product 140 to equalize or stabilize. In another example, the veneer product 137 can be incorporated into one or more finished products such as plywood and/or laminated veneer lumber. For example, the moisture concentration of two or more veneers 135 can be estimated at one or more locations thereabout and the liquid can be contacted with at least a portion of the locations having a moisture concentration below the minimum moisture concentration level to provide finished veneers 140. An adhesive can be applied to at least one surface of at least one finished veneer 140. The finished veneers 140 can be contacted with one another such that the adhesive is at least partially disposed between the finished veneers 140. The adhesive can be at least partially cured to produce a finished product such as plywood and/or laminated veneer lumber. At least partially curing the adhesive can include applying heat and/or pressure to the finished veneers contacted with one another.

Embodiments of the present disclosure further relate to any one or more of the following paragraphs:

1. A method for adjusting a moisture concentration of a veneer, comprising: estimating a moisture concentration of a veneer surface at one or more locations thereon; comparing the one or more estimated locations to a minimum moisture concentration level; and moisturizing at least a portion of the one or more estimated locations that are below the minimum moisture concentration level to increase the moisture concentration thereof.

2. The method according to paragraph 1, wherein the minimum moisture concentration level is about 5 wt % or more, based on a dry weight of the veneer.

3. The method according to paragraph 1 or 2, wherein moisturizing the at least a portion of the one or more estimated locations produces a veneer product having a moisture concentration ranging from about 7 wt % to about 40 wt %, based on a dry weight of the veneer.

4. The method according to any one of paragraphs 1 to 3, wherein the veneer is at a temperature ranging from about 35° C. to about 60° C. and the veneer is moisturized with a liquid at a temperature ranging from about 35° C. to about 60° C.

5. The method according to any one of paragraphs 1 to 4, wherein the veneer has an average thickness ranging from about 1.5 mm to about 4.5 mm.

6. The method according to any one of paragraphs 1 to 5, wherein the veneer is moisturized with a liquid comprising water.

7. The method according to any one of paragraphs 1 to 6, wherein the veneer is moisturized with a liquid comprising atomized water.

8. The method according to any one of paragraphs 1 to 7, wherein the veneer is moisturized with an atomized liquid, and wherein an average droplet cross-sectional size of the atomized liquid is less than about 150 μm.

9. The method according to any one of paragraphs 1 to 8, wherein the veneer is moisturized with an atomized liquid, and wherein an average droplet cross-sectional size of the atomized liquid ranges from about 30 μm to about 70 μm.

10. A method for adjusting a moisture concentration of a veneer, comprising: estimating a moisture concentration about a surface of at least a first veneer and a second veneer at a plurality of locations; determining which of the plurality of estimated moisture concentration locations are below a minimum moisture concentration level; and contacting at least a portion of the locations that are below the minimum moisture concentration level with a liquid to increase the moisture concentration thereof to produce a first and second veneer product.

11. The method according to paragraph 10, further comprising: applying an adhesive to at least a portion of a first surface of at least one of the first and second veneer products; contacting the first and second veneer products with one another such that at least a portion of the adhesive is located between the first and second veneer products; and at least partially curing the adhesive to produce a finished product.

12. The method according to paragraph 11, wherein the finished product is plywood or laminated veneer lumber.

13. The method according to any one of paragraphs 10 to 12, wherein contacting the at least a portion of the locations with the liquid produces first and second veneer products having a moisture concentration ranging from about 5 wt % to about 40 wt %, based on a dry weight of the veneer.

14. The method according to any one of paragraphs 10 to 13, wherein the first and second veneers are contacted with a liquid comprising water.

15. The method according to any one of paragraphs 10 to 14, wherein the first and second veneers are contacted with a liquid comprising atomized water.

16. A system for adjusting a moisture concentration of a veneer, comprising: a moisture estimation system for estimating a moisture concentration of a veneer surface at one or more locations thereon; a control system for comparing the one or more estimated locations to a minimum moisture concentration level; and a re-wet system for moisturizing at least a portion of the one or more estimated locations that are below the minimum moisture concentration level to increase the moisture concentration thereof.

17. The system according to paragraph 16, wherein the re-wet system comprises a plurality of nozzles for emitting an atomized liquid therefrom, and wherein each nozzle in the plurality of nozzles is independently actuated between an on state and an off state.

18. The system according to paragraph 17, wherein each nozzle emits the atomized liquid at a constant flow rate when in the on position.

19. The system according to any one of paragraphs 16 to 18, wherein the moisture concentration is estimated about a first side of the veneer, and wherein the liquid is contacted with a second side of the veneer that opposes the first side.

20. The system according to any one of paragraphs 16 to 19, wherein the moisture estimation system comprises a plurality of conductive contacts configured to contact the veneer surface.

21. A method for adjusting a moisture concentration of a veneer, comprising: estimating a moisture concentration about a plurality of locations on a surface of a veneer to provide a plurality of estimated moisture concentration locations; comparing at least a portion of the plurality of estimated moisture concentration locations to one another to provide at least a first set and a second set of estimated moisture concentration locations, wherein the first set comprises locations having a first average moisture concentration and the second set comprises locations having a second average moisture concentration, and wherein the second average moisture concentration is less than the first average moisture concentration; moisturizing at least a portion of the second set of estimated moisture concentration locations to produce a veneer product having a more uniform moisture concentration as compared to the veneer before moisturizing at least a portion of the second set of estimated moisture concentration locations, wherein moisturizing the at least a portion of the second set of estimated moisture concentration locations comprises contacting the veneer with an atomized liquid.

22. The method according to paragraph 21, wherein the atomized liquid has an average droplet cross-sectional size less than about 150 μm.

23. The method according to paragraph 21, wherein the atomized liquid has an average droplet cross-sectional size ranging from about 30 μm to about 70 μm.

24. The method according to any one of paragraphs 21 to 23, wherein the veneer product has an average moisture concentration ranging from about 7 wt % to about 40 wt %, based on a dry weight of the veneer.

25. The method according to any one of paragraphs 21 to 24, wherein the veneer product has an average moisture concentration ranging from about 7 wt % to about 40 wt %, based on a dry weight of the veneer, and wherein the moisture concentration between any two given locations varies by less than about 20% with respect to one another.

26. The method according to any one of paragraphs 21 to 25, wherein the veneer is at a temperature ranging from about 35° C. to about 60° C. and the atomized liquid is at a temperature ranging from about 35° C. to about 60° C.

27. The method according to any one of paragraphs 21 to 26, wherein the veneer has an average thickness ranging from about 1.5 mm to about 4.5 mm.

28. The method according to any one of paragraphs 21 to 27, wherein the atomized liquid comprises water.

29. A system for adjusting a moisture concentration of a veneer, comprising: a moisture estimation system for estimating a moisture concentration of a veneer surface at one or more locations thereon; a control system for comparing at least a portion of the plurality of estimated moisture concentration locations to one another to provide at least a first set and a second set of estimated moisture concentration locations, wherein the first set comprises locations having a first average moisture concentration and the second set comprises locations having a second average moisture concentration, and wherein the second average moisture concentration is less than the first average moisture concentration; and a re-wet system for moisturizing at least a portion of the second set of estimated moisture concentration locations to produce a veneer product having a having a more uniform moisture concentration as compared to the veneer before moisturizing at least a portion of the second set of estimated moisture concentration locations, wherein moisturizing the at least a portion of the second set of estimated moisture concentration locations comprises contacting the veneer with an atomized liquid.

30. The system according to paragraph 29, wherein the re-wet system comprises a plurality of nozzles for emitting the atomized liquid therefrom.

31. The system according to paragraph 30, wherein each nozzle is independently actuated between an on state and an off state.

32. The system according to paragraph 31, wherein each nozzle emits the atomized liquid at a constant flow rate when in the on state.

33. The system according to any one of paragraphs 29 to 32, wherein the moisture concentration is estimated about a first side of the veneer, and wherein the atomized liquid is contacted with a second side of the veneer that opposes the first side.

34. The system according to any one of paragraphs 29 to 33, wherein the moisture concentration is estimated about a first side of the veneer, and wherein the atomized liquid is contacted with the first side of the veneer.

35. The system according to any one of paragraphs 29 to 34, wherein the moisture estimation system comprises a plurality of conductive contacts configured to contact the veneer surface.

36. A method for adjusting a moisture concentration of a veneer, comprising: estimating a moisture concentration of a veneer surface at one or more locations thereon; and moisturizing at least a portion of the one or more estimated locations with an atomized liquid to produce a veneer product.

37. The method according to paragraph 36, wherein the veneer product has a moisture concentration ranging from about 7 wt % to about 40 wt %, based on a dry weight of the veneer.

38. The method according to paragraph 36 or 37, wherein the veneer is at a temperature ranging from about 35° C. to about 60° C. and the veneer is moisturized with atomized liquid at a temperature ranging from about 35° C. to about 60° C.

39. The method according to any one of paragraphs 36 to 38, wherein the veneer has an average thickness ranging from about 1.5 mm to about 4.5 mm.

40. The method according to any one of paragraphs 36 to 39, wherein the atomized liquid comprises water.

41. The method according to any one of paragraphs 36 to 40, wherein an average droplet cross-sectional size of the atomized liquid is less than about 150 μm.

42. The method according to any one of paragraphs 36 to 41, wherein an average droplet cross-sectional size of the atomized liquid ranges from about 30 μm to about 70 μm.

43. The method according to any one of claims 36 to 42, wherein the veneer product has an average moisture concentration ranging from about 7 wt % to about 40 wt %, based on a dry weight of the veneer, and wherein a moisture concentration between any two given locations varies by less than about 20% with respect to one another.

44. A system for adjusting a moisture concentration of a veneer, comprising: a moisture estimation system for estimating a moisture concentration of a veneer surface at one or more locations thereon; and a re-wet system for moisturizing at least a portion of the one or more estimated locations with an atomized liquid to produce a veneer product.

45. The system according to paragraph 44, wherein the re-wet system comprises a plurality of nozzles for emitting the atomized liquid therefrom.

46. The system according to paragraph 45, wherein each nozzle is independently actuated between an on state and an off state.

47. The system according to paragraph 46, wherein each nozzle emits the atomized liquid at a constant flow rate when in the on state.

48. The system according to any one of paragraphs 44 to 47, wherein the moisture concentration is estimated about a first side of the veneer, and wherein the atomized liquid is contacted with a second side of the veneer that opposes the first side.

49. The system according to any one of paragraphs 44 to 48, wherein the moisture estimation system comprises a plurality of conductive contacts configured to contact the veneer surface.

50. The system according to any one of paragraphs 44 to 49, wherein the moisture estimation system comprises a plurality of conductive contacts configured to contact the veneer surface.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A system for adjusting a moisture concentration of a veneer, comprising:

a moisture estimation system for estimating moisture concentrations of a veneer at multiple locations about an upper surface thereof, wherein the veneer has varying moisture concentrations across the upper surface;

a control system for comparing the estimated moisture concentrations to a minimum moisture concentration level; and a re-wet system for moisturizing deficient locations that are below the minimum moisture concentration level to increase the moisture concentrations at the deficient locations above the minimum moisture concentration level to produce a veneer product with moisturized locations having varying moisture concentrations across the upper surface and above the minimum moisture concentration level, wherein:

the re-wet system comprises a plurality of nozzles for emitting an atomized liquid having an average droplet cross-sectional size of about 1 μm to about 150 μm, the re-wet system moisturizes the deficient locations that are below the minimum moisture concentration level using the atomized liquid, and the moisture concentration of the moisturized locations vary by about 5% to about 20% with respect to one another.

2. The system of claim 1, wherein each nozzle in the plurality of nozzles is independently operable between an on state and an off state, and wherein each nozzle in the plurality of nozzles emits the atomized liquid at a constant flow rate when in the on state.

3. The system of claim 1, wherein the moisture concentrations of the moisturized locations vary by about 10 % to about 20% with respect to one another.

4. The system of claim 1, wherein the re-wet system moisturizes the upper surface, a lower surface of the veneer that is opposite the upper surface, or both the upper surface and the lower surface.

5. The system of claim 1, wherein the moisture estimation system comprises a plurality of conductive contacts for contacting the upper surface.

6. The system of claim 1, wherein the moisture concentrations of the moisturized locations vary by about 5% to about 15% with respect to one another.

7. The system of claim 1, wherein the atomized liquid has an average droplet cross-sectional size of about 1μm to about 100μm.

8. The system of claim 1, wherein the atomized liquid has an average droplet cross-sectional size of about 1μm to about 100μm, and wherein the moisture concentrations of the moisturized locations vary by about 10 % to about 20 % with respect to one another.

9. A system for adjusting a moisture concentration of a veneer, comprising:

a moisture estimation system for estimating moisture concentrations of a veneer at a plurality of locations about a first surface thereof, wherein the veneer has varying moisture concentrations about the first surface;

a control system for comparing the estimated moisture concentrations to a minimum moisture concentration level; and a re-wet system for moisturizing deficient locations that are below the minimum moisture concentration level to increase the moisture concentrations at the deficient locations above the minimum moisture concentration level to produce a veneer product with moisturized locations having varying moisture concentrations across the first surface thereof and above the minimum moisture concentration level, wherein:

the re-wet system comprises a plurality of nozzles for emitting an atomized liquid having an average droplet cross-sectional size of about 1 μm to about 150 μm, the re-wet system moisturizes the deficient locations that are below the minimum moisture concentration level using the atomized liquid, and the moisture concentrations of the moisturized locations vary by about 5 % to about 20 % with respect to one another.

10. The system of claim 9, wherein the atomized liquid has an average droplet cross-sectional size of about 1μm to about 100 μm.

11. The system of claim 9, wherein the moisture concentrations of the moisturized locations vary by about 10% to about 20% with respect to one another.

12. The system of claim 9, wherein the moisture concentrations of the moisturized locations vary by about 5% to about 15% with respect to one another.

13. The system of claim 9, wherein the atomized liquid has an average droplet cross-sectional size of about 1 μm to about 100 μm, and wherein the moisture concentrations of the moisturized locations vary by about 10 % to about 20 % with respect to one another.

14. A system for adjusting a moisture concentration of a veneer, comprising:

a moisture estimation system for estimating moisture concentrations of a veneer at a plurality of locations about a first surface thereof, wherein the veneer has varying moisture concentrations about the first surface;

a control system for comparing the estimated moisture concentrations to a minimum moisture concentration level; and a re-wet system for moisturizing deficient locations that are below the minimum moisture concentration level to increase the moisture concentrations at the deficient locations above the minimum moisture concentration level to produce a veneer product with moisturized locations having varying moisture concentrations across the first surface thereof and above the minimum moisture concentration level, wherein:

the re-wet system moisturizes the first surface, a second surface of the veneer that is opposite the first surface, or both the first surface and the second surface, the re-wet system comprises a plurality of nozzles for emitting an atomized liquid having an average droplet cross-sectional size of about 1 μm to about 150 μm , the re-wet system moisturizes the deficient locations that are below the minimum moisture concentration level using the atomized liquid, and the moisture concentrations of the moisturized locations vary by about 5% to about 20% with respect to one another.

15. The system of claim 14, wherein the atomized liquid has an average droplet cross-sectional size of about 1μm to about 100μm.

16. The system of claim 14, wherein the moisture concentrations of the moisturized locations vary by about 10% to about 20% with respect to one another.

17. The system of claim 14, wherein the moisture concentrations of the moisturized locations vary by about 5% to about 15% with respect to one another.

18. The system of claim 14, wherein the atomized liquid has an average droplet cross-sectional size of about 1μm to about 100 μm, and wherein the moisture concentrations of the moisturized locations vary by about 10 % to about 20% with respect to one another.

19. The system of claim 14, wherein the atomized liquid has an average droplet cross-sectional size of about 1 μm to about 100 μm, and wherein the moisture concentrations of the moisturized locations vary by about 10% to about 20% with respect to one another.

20. The system of claim 14, wherein the atomized liquid has an average droplet cross-sectional size of about 1 μm to about 100 μm, wherein each nozzle in the plurality of nozzles is independently operable between an on state and an off state, wherein each nozzle in the plurality of nozzles emits the atomized liquid at a constant flow rate when in the on state, and wherein the moisture concentrations of the moisturized locations vary by about 10% to about 20% with respect to one another.

* * * * *